US006619427B1

(12) United States Patent
Kerr

(10) Patent No.: US 6,619,427 B1
(45) Date of Patent: Sep. 16, 2003

(54) FOLDABLE DUAL TRACK LADDER

(75) Inventor: James F. Kerr, Croswell, MI (US)

(73) Assignee: Material Control, Inc., Croswell, MI (US)

( * ) Notice: Subject to any disclaimer, the term of this patent is extended or adjusted under 35 U.S.C. 154(b) by 0 days.

(21) Appl. No.: 10/119,271

(22) Filed: Apr. 9, 2002

(51) Int. Cl.[7] ..... E04G 3/14
(52) U.S. Cl. ..... 182/39; 182/36
(58) Field of Search ..... 182/39, 38, 15, 182/17, 97, 80, 84, 115, 36, 37, 83, 85, 12; 104/91, 93

(56) References Cited

U.S. PATENT DOCUMENTS 5,148,889 A * 9/1992 Fenwick et al. ..... 182/17
5,480,002 A * 1/1996 Kerr ..... 182/38
6,230,841 B1 * 5/2001 Valore ..... 182/39

* cited by examiner

*Primary Examiner*—Hugh B. Thompson
(74) *Attorney, Agent, or Firm*—Dykema Gossett PLLC

(57) ABSTRACT

The ladder system is disposed between two spaced storage shelves of the types found in crowded warehouse-type retail outlets. The ladder is mounted on an overhead track system and may be moved longitudinally along the shelves and laterally between the shelves. The ladder is pivotly connected on one side to the overhead track system whereby the ladder may be moved from a latched position to a folded position about the pivot means against one of the storage shelves to thereby minimize the ladder as an obstruction in the aisle between the storage shelves.

23 Claims, 4 Drawing Sheets

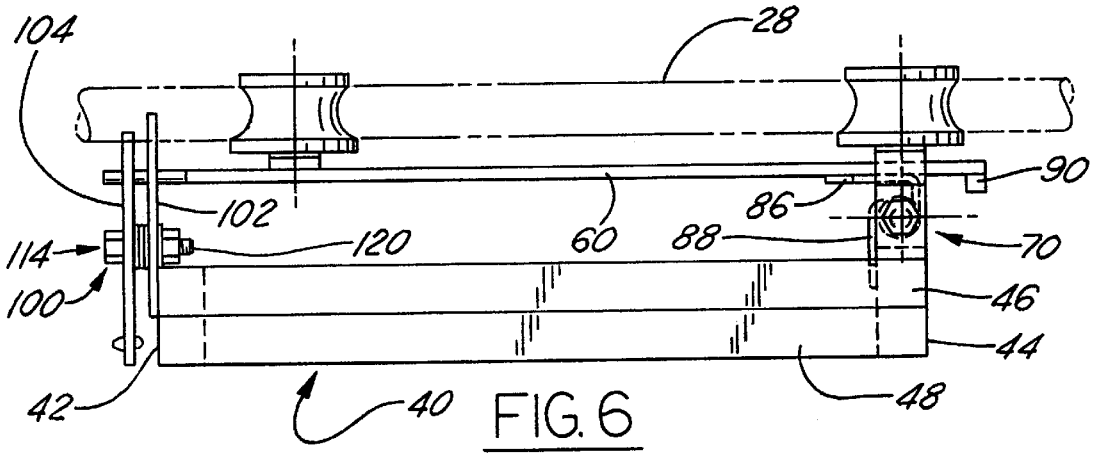
FIG. 6
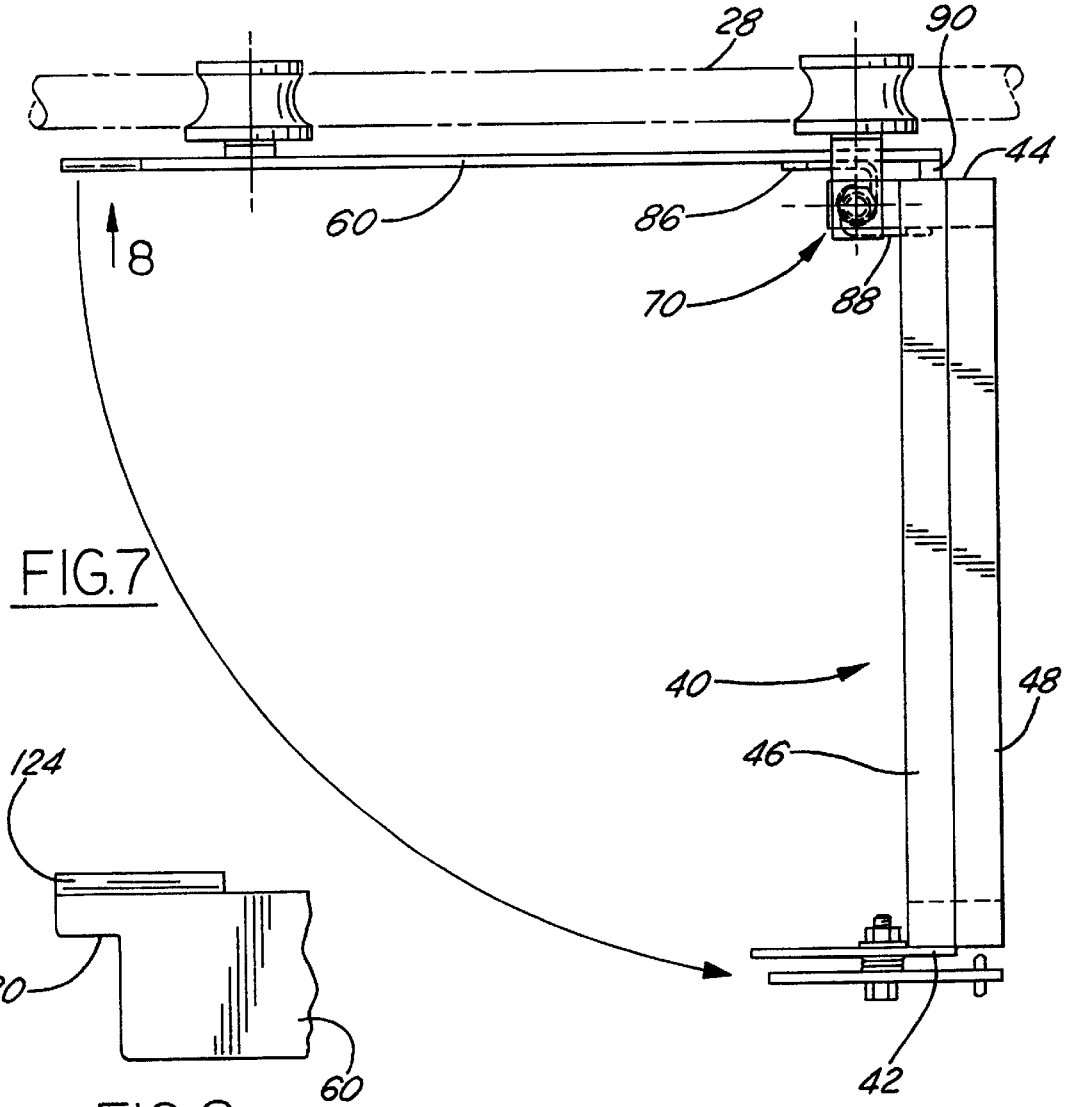
FIG. 7
FIG. 8

FOLDABLE DUAL TRACK LADDER

BACKGROUND OF THE INVENTION

This application relates to a ladder system for use with a pair of spaced storage shelves in a store or warehouse. My prior U.S. Pat. No. 5,413,191, issued May 9, 1995, entitled "Dual Track Ladder", has been well received by customers. However, because of the orientation of the ladder and narrow aisles or aisleways provided in some stores and warehouses, some customers opined that the ladder was too wide and consumed too much of the width of the aisle. In certain cases, it was difficult for employees to get past the ladder, particularly when they were carrying packages or other objects. In one instance, local codes would not permit the use of the dual track ladder of the type shown in my patent.

SUMMARY OF THE INVENTION

The dual track ladder has been redesigned to include a feature that will permit it to fold out of the way against the rack or storage shelf when not in use. With such a feature, the ladder uses only a small part of the aisle width permitting easy access by employees to use the aisleway. Such feature meets local building codes and regulations.

In a disclosed embodiment of the present invention, a ladder system is disclosed for positioning a ladder in an aisle between a pair of spaced storage shelves which are positioned on the floor. An overhead track system is adapted to be attached to at least one of the storage shelves, with the ladder being mounted on the track system for selective movement in a longitudinal direction only or in a lateral direction or in both the longitudinal and lateral directions simultaneously.

The overhead track system includes first and second guide tracks, with the guide tracks extending in a longitudinal direction which parallel the shelves. The track system further includes a first rod extending in a lateral direction which is perpendicular to the shelves and between the guide tracks, with the first rod being coupled to the first and second guide tracks for longitudinal movement along the guide tracks.

In a preferred embodiment of this invention, a mounting bar is attached to the ladder, with pairs of spaced apart rollers being carried by the mounting bar. Pivot means are provided connecting the ladder to the mounting bar, with the pivot means being located on one side of the ladder. Latch means are carried by the ladder for engagement with the mounting bar, with the latch means being located on the other side of the ladder. With such a construction, the latch means when in an engaged position holds the ladder to the mounting bar in a latched position to permit the ladder to move along the rollers in the lateral direction between the storage shelves. When the latch means are disengaged from the mounting bar, this permits the ladder to pivot a or swing on the pivot means and to be moved against one of the storage shelves thereby decreasing blockage of the aisle between the storage shelves by the ladder. Thus, mounting the ladder in the manner described permits the ladder to be folded or turned and to be thereby moved against the side of the one of the storage shelves. Such a construction complies with local ordinances and regulations.

When using the ladder system of the present invention, a person rolls the ladder longitudinally along the storage shelves until one reaches a location which corresponds to the location where one wishes to remove from or store packages on the shelves. The ladder may be moved laterally to go around obstructions in the aisle or to position the ladder adjacent a particular shelf. In addition, the ladder may be pivoted to move over an obstruction or to facilitate movement of the ladder. Finally, the ladder may be folded to move the ladder against one side of a storage shelf thereby decreasing blockage of the aisle.

BRIEF DESCRIPTION OF THE DRAWINGS

FIG. 6 is a top view of the ladder and mounting structure illustrating the ladder, latch mechanism, mounting bar, rollers and a guide rail, with the ladder maintained in a latched position.

FIG. 7 is a top view of the ladder and mounting structures after the latch has been released from the mounting plate and the ladder turned about the pivot means.

FIG. 8 is a fragmentary front elevational view of one end of the mounting bar which is engaged by the latch when the ladder is in a latched position.

DETAILED DESCRIPTION OF THE PREFERRED EMBODIMENT

Figure 1:
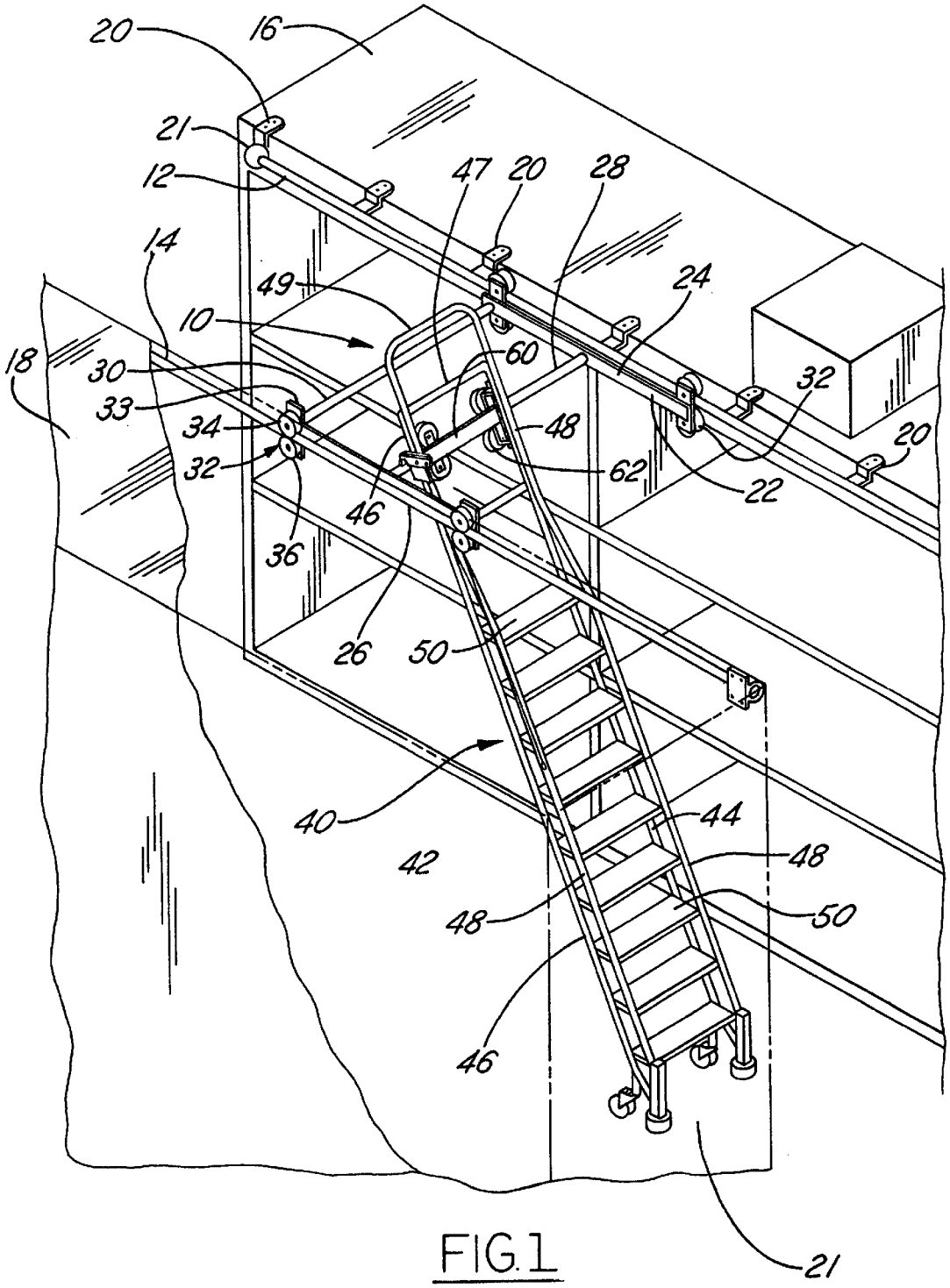
FIG. 1 is a partially cut away perspective view of a ladder system according to the present invention, with the ladder being located in the aisle between laterally spaced storage shelves.
Figure 2:
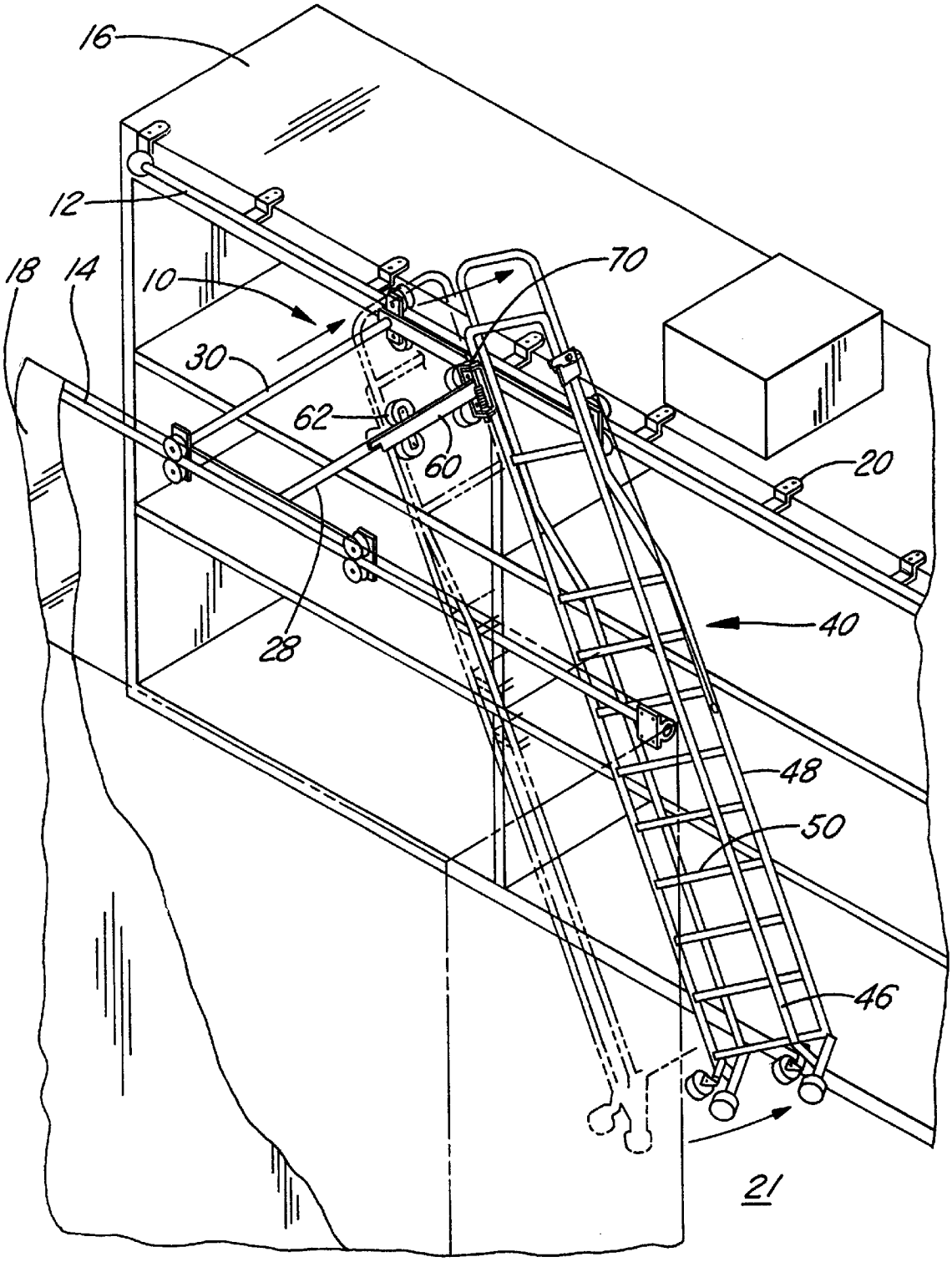
FIG. 2 is a cut away perspective view of the present invention, similar to FIG. 1, but illustrating the ladder in a folded position against the side of one of the shelves, thereby reducing blockage of the aisle.

Referring now to the drawings, FIG. 1 illustrates a ladder system 10. The ladder system 10 includes a first overhead guide track 12 and a overhead second guide track 14 mounted on shelving units or storage shelves 16 and 18 respectively. Guide tracks 12 and 14 are mounted at the front surface or side of the spaced storage shelves 16 and 18 by means of a plurality of longitudinally spaced brackets 20, or end mounts 21, or other mounting devices. The storage shelves 16 and 18 are usually mounted on the floor of a building or warehouse, with the space between the shelves 16 and 18 defining an aisle or aisleway 21. In the application the term "longitudinal direction" is defined as extending parallel to the spaced storage shelves 16 and 18 and the term "lateral direction" is defined as extending between the shelves 16 and 18.

The track system 10 further includes an overhead carriage or roller structure 22. The carriage or roller structure 22 is mounted for longitudinal movement along the guide tracks 12 and 14. The carriage or roller structure 22 includes side walls 24 and 26, associated with guide tracks 12 and 14 respectively. The carriage 22 further includes a first rod 28 and a second rod 30. The longitudinal ends of each side walls 24 and 26 of the carriage 22 have mounted thereon a pair of roller sets 32, thereby providing two pairs of rollers on each of the guide tracks 12 and 14. With such a construction, the carriage or roller structure 22 is mounted for longitudinal movement in a direction parallel to the shelves 16 and 18.

Each roller set 32 has a bracket 33 attached to one of the side walls, an upper roller 34 and a lower roller 36. The two pairs of roller sets 32 which are carried on each of the side walls 24 and 26 have annular curved surfaces which are received on the guide tracks 12 and 14 which are of circular cross section. The track system 10 includes the ladder 40 having a first side 42 and a second side 44. Each side 42, 44 has a pair of side rails 46 and 48. The side rails 46 and 48 support the vertically spaced steps or stairs 50. The upper ends of the side rails 48 near the highest step 50 bends rearwardly and abuts the other side rails 46. The side rails 46 are connected at the top by a cross rail 47, while the rails 48 at the top are connected by a cross rail 49. The side rails 48 form hand rails which a person grips when climbing the ladder 40.

The mounting structure for the ladder 40 includes a mounting bar 60 to which are rotatably carried two pairs of roller sets 62. One roller set 62 has a bracket 64 which is welded or otherwise secured to one end of the mounting bar 60. The bracket 64 maintains the rollers 66 and 68 in spaced relationship. The rollers are of arcuate configuration and are designed to ride along the first rod 28 as will subsequently be described. The other roller set 62 is mounted on a C-shaped bracket 74, which is welded to the other end of the mounting bar 60.

Figure 3:
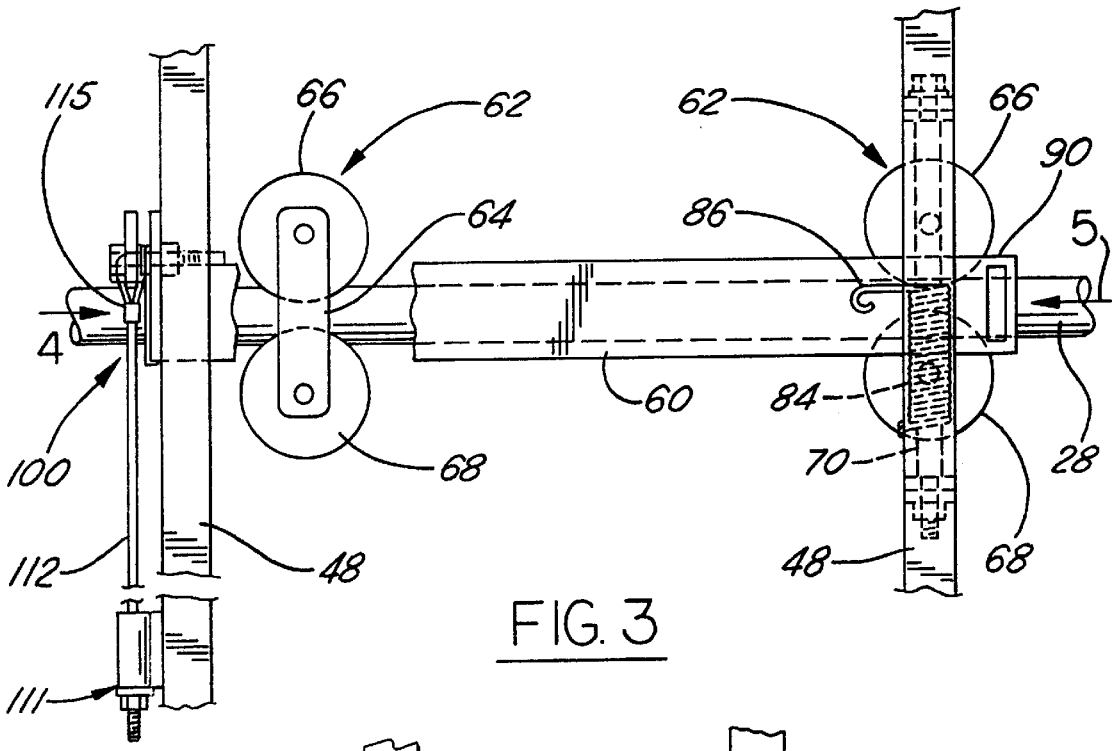
FIG. 3 is a fragmentary front elevational view of the upper part of the ladder, illustrating the mounting bar and roller construction to Which the ladder is pivotally mounted.
Figure 5:
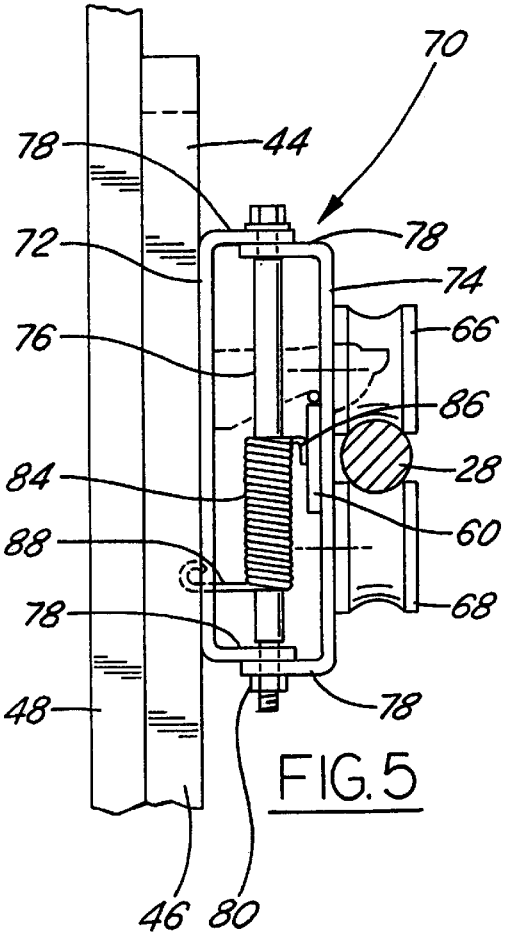
FIG. 5 is a side elevational view looking in the direction of arrow 5 of FIG. 3 and illustrating the pivot mounting between the ladder and the mounting bar.

The ladder 10 near the upper end of the first side 44 is provided with a pivot mechanism, assembly or means 70. The pivot mechanism 70 includes a C-shaped bracket 72 which is secured with ladder rail 46. The corresponding C-shaped bracket 74 is secured to the mounting bracket 60 as previously described. An elongated bolt or mounting member 76 extends through the overlapping upper and lower flanges 78 of brackets 72 and 74 and is retained by the nut 80 which is threaded onto the threaded end of the bolt 76. A torsion spring 84 is coiled around portions of the bolt 76, with the spring 84 having ends 86 and 88. The spring end 86 abuts the front face of the mounting bar 60 as best illustrated in FIGS. 3 and 5. The other spring end 88 contacts the ladder side rail 46. When the ladder 10 is unlatched from the mounting bar 60, to be subsequently described, it swings about the pivot mechanism or assembly 70 from the position illustrated in FIG. 5, the latched position, to the position illustrated in FIG. 7, the folded position. The mounting plate 60 includes a bar 90 which forms an abutment for the ladder 40 as best illustrated in FIGS. 3, 6 and 7. The abutment 90 limits the swinging or turning movement of the ladder 40 as illustrated in FIG. 7.

Figure 4:
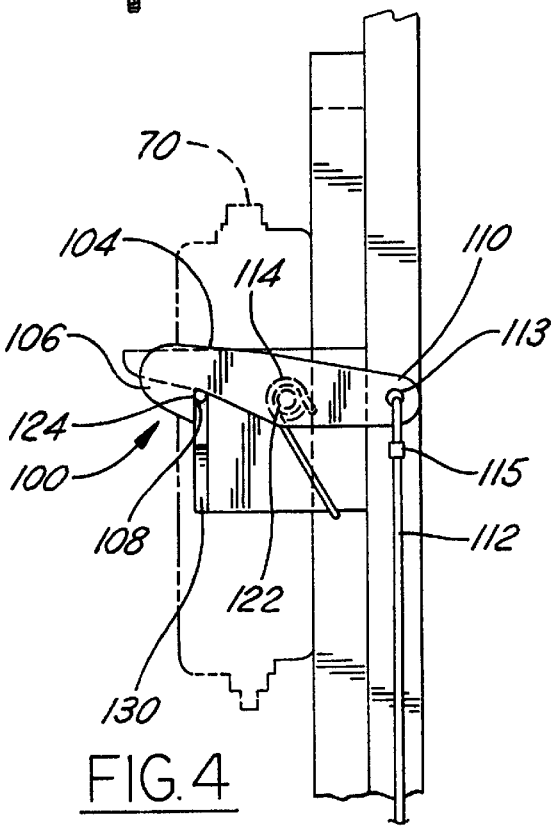
FIG. 4 is a side elevational view of the latch mechanism and operating cable looking in the direction of arrow 4 of FIG. 3 and illustrating the latch in an engaged position with the mounting bar.

The other side 42 of ladder 40 is provided with a latch mechanism 100. The latch mechanism 100 includes a latch mounting plate 102 and a latch or lever 104. The latch plate is attached to the ladder side rails 46 and 48 on side 42 at the place where they abut near the top of the ladder. The latch 104 has on one end a head 106 provided with a latching surface 108. The other end 110 of the latch 104 provides an anchor for an actuating cable 112. An end of the cable 112 extends through an opening 113 provided in the latch end 110, with the ends thereafter tied to the main cable 112 in an appropriate fashion by means of a cable tie or nut 115. The other end of the cable 112 is retained by a fastening device 111 as illustrated in FIG. 3. A pivot mechanism 114 is mounted between the head 106 and anchor end 110 of the latch 104. A bolt 120 extends through aligned openings provided in the lever 104 and the plate 102. A biasing spring 122 is wrapped around the bolt 120 and biases the latch 104 to a latched position, with the surface 108 engaging the mounting bar 60. The top surface of the mounting bar 60 at the actuating end is provided with a relatively short rod 124 of circular configuration. The rod 124 overlies a cutout or notch provided in the mounting bar 60 as shown in FIG. 8. The rod 124 is engaged by the latching surface 108 of the latch 104 as illustrated in FIG. 4.

As indicated previously, the ladder 40 may move longitudinally along the shelves and may also be moved laterally between the shelves. In addition, the ladder may pivot about the pairs of roller sets 62 on the first rod 28 so that the ladder 40 may be picked up over obstructions in an aisle between the shelves. Thus, one can quickly and easily position the ladder 40 at any position along or between the two shelves for accessing items stored on the shelves. In addition, the present invention is directed to the addition feature of folding the ladder to one side of the aisle against one the shelves. Thus, the ladder system is particularly useful in a crowded warehouse-type retail outlets.

It should also be understood that other types of ladders, such as those having safety structures including platforms or gates, may incorporate the inventive structure. Moreover the ladder 40 may be formed of wood, any suitable metal or other appropriate material.

It should be recognized that while a preferred embodiment of the present invention has been disclosed, a worker of ordinary skill in the art would recognize that certain modifications would come within the scope of this invention. For that reason, the following claims should be studied in order to determine the true scope and content of this invention.

What I claim is:

1. A ladder system for positioning a ladder in an aisle between a pair of spaced storage shelves which are positioned on a floor, a longitudinal direction being defined as extending parallel to the spaced storage shelves and a lateral direction being defined as extending between said spaced storage shelves, the ladder system comprising:

a non-foldable ladder in the aisle adapted to contact the floor;

an overhead track system adapted to be attached to at least one of said storage shelves, said ladder being mounted on said track system for selective movement along said longitudinal direction only, along said lateral direction only, and along both said longitudinal direction and said lateral direction simultaneously;

said track system including a first guide track and a second guide track, said guide tracks extending along said longitudinal direction, said track system further including a first rod extending in a lateral direction between said guide tracks, said first rod being coupled to said first and second guide tracks for longitudinal movement along said guide tracks;

a mounting bar for said ladder;

a pair of spaced apart rollers attached to said mounting bar and engagable with said first rod;

a pivot connecting said ladder to said mounting bar, said pivot being located at one side of said ladder;

a latch carried by said ladder for engagement with said mounting bar;

said latch being located at the other side of said ladder opposite said pivot;

said latch when in an engaged position, holding said ladder in a latched position with said mounting bar to permit the ladder to move along said first rod laterally between said storage shelves;

said latch when disengaged from said mounting bar permitting the ladder to turn about said pivot and to be moved against one of said storage shelves with the ladder maintaining contact with the floor thereby decreasing blockage of the aisle between the storage shelves by said ladder.

2. The ladder system as recited in claim 1, wherein said pair of rollers are spaced apart a distance that is generally a diameter of said first rod, said first rod being interposed between said pair of rollers, said rollers cooperatively gripping said first rod and guiding said ladder for lateral and pivoting movement relative to said first rod, said ladder being moveable laterally between said first and second guide tracks;

said guide tracks being associated with said storage shelves, said first rod being rigidly secured to and extending between said storage shelves; and a second rod is rigidly secured to and extends between said storage shelves for providing increased stability.

3. A The ladder system as recited in claim 2 wherein a second pair of said rollers are spaced apart along said first rod in said lateral direction for guiding said ladder.

4. A The ladder system as recited in claim 2 wherein said pair of rollers have curved surfaces received on said first rod corresponding to the outer periphery of said first rod such that said pair of rollers may pivot about said first rod.

5. The ladder system as recited in claim 1 wherein said pivot means include a pair of brackets, one bracket affixed to said mounting bar and the other bracket affixed to said ladder; and a pivot bolt interposed between said brackets to permit said ladder to be swung to one side of the aisle against one of the storage shelves.

6. The ladder system as defined in claim 5 wherein spring biasing means are provided which extend around said pivot bolt and has an end abutting said mounting-bar.

7. A ladder system for positioning a ladder in an aisle between a pair of spaced storage shelves which are positioned on a floor, a longitudinal direction being defined as extending parallel to the spaced storage shelves and a lateral direction being defined as extending between said spaced storage shelves, the ladder system comprising:

a ladder in the aisle adapted to contact the floor;

an overhead track system adapted to be attached to at least one of said storage shelves, said ladder being mounted on said track system for selective movement along said longitudinal direction only, along said lateral direction only, and along both said longitudinal direction and said lateral direction simultaneously;

said track system including a first guide track and a second guide track, said guide tracks extending along said longitudinal direction, said track system further including a first rod extending in a lateral direction between said guide tracks, said first rod being coupled to said first and second guide tracks for longitudinal movement along said guide tracks;

a mounting bar for said ladder;

a pair of spaced apart rollers attached to said mounting bar and engagable with said first rod;

a pivot connecting said ladder to said mounting bar, said pivot being located at one side of said ladder;

a latch carried by said ladder for engagement with said mounting bar;

said latch being located at the other side of said ladder opposite said pivot;

said latch when in an engaged position, holding said ladder in a latched position with said mounting bar to permit the ladder to move along said first rod laterally between said storage shelves;

said latch when disengaged from said mounting bar permitting the ladder to turn about said pivot and to be moved against one of said storage shelves thereby decreasing blockage of the aisle between the storage shelves by said ladder;

a latch plate attached to said ladder;

a pivot connecting said latch to said latch plate;

spring means interposed between said latch means and said latch plate for biasing said latch to a latched position on said mounting bar; and an actuating cable attached to said latch for moving it about said pivot to disengage same from said mounting bar, thereby permitting the ladder to be turned about said pivot to one side of the aisle against one of the storage shelves.

8. The ladder system as recited in claim 7, wherein said pair of rollers are spaced apart a distance that is generally a diameter of said first rod, said first rod being interposed between said pair of rollers, said rollers cooperatively gripping said first rod and guiding said ladder for lateral and pivoting movement relative to said first rod, said ladder being moveable laterally between said first and second guide tracks;

said guide tracks being associated with said storage shelves, said first rod being rigidly secured to and extending between said storage shelves; and a second rod is rigidly secured to and extends between said storage shelves for providing increased stability.

9. A The ladder system as recited in claim 8, wherein a second pair of said rollers are spaced apart along said first rod in said lateral direction for guiding said ladder.

10. A The ladder system as recited in claim 8 wherein said pair of rollers have curved surfaces received on said first rod corresponding to outer periphery of said first rod such that said pair of rollers may pivot about said first rod.

11. A The ladder system as recited in claim 7 wherein said pivot means include a pair of brackets, one bracket affixed to said mounting bar and the other bracket affixed to said ladder; and a pivot bolt interposed between said brackets to permit said ladder to be swung to one side of the aisle against one of the storage shelves.

12. The ladder system as defined in claim 11 wherein spring biasing means are provided which extend around said pivot bolt and has an end abutting said mounting bar.

13. A ladder system for positioning a ladder in an aisle between a pair of spaced storage shelves which are positioned on a floor, a longitudinal direction being defined as extending parallel to the spaced storage shelves and a lateral direction being defined as extending between said spaced storage shelves, the ladder system comprising:

a non-foldable ladder in the aisle adapted to contact the floor;

an overhead track system adapted to be attached to said storage shelves, said ladder being mounted on said track system for selective movement in said longitudinal direction only, in said lateral direction only, and in both said longitudinal direction and said lateral direction simultaneously;

said track system including a first guide track and a second guide track, said guide tracks extending in said longitudinal direction, said track system further including a longitudinally movable roller carriage having a series of rollers on each of said guide tracks, said carriage having a first rod extending in a lateral direction between said guide tracks, said first rod being coupled to said carriage for longitudinal movement along said guide tracks;

a mounting bar for said ladder;

pairs of spaced apart rollers attached to said mounting bar and engagable with said first rod;

a pivot connecting said ladder to said mounting bar, said pivot being located at one side of said ladder;

a latch carried by said ladder for engagement with said mounting bar;

said latch being located at the other side of said ladder opposite said pivot;

said latch when in an engaged position, holding said ladder in a latched position with said mounting bar to permit the ladder to move along said first rod laterally between said storage shelves;

said latch when disengaged from said mounting bar permitting the ladder to turn about said pivot and to be moved against one of said storage shelves with the ladder maintaining contact with the floor thereby decreasing blockage of the aisle between the storage shelves by said ladder.

14. The ladder system as recited in claim 13, wherein said pairs of rollers are spaced apart a distance that is generally a diameter of said first rod, said first rod being interposed between said pairs of rollers, said rollers cooperatively gripping said first rod and guiding said ladder for lateral and pivoting movement relative to said first rod, said ladder being moveable laterally between said first and second guide tracks;

said guide tracks being associated with said storage shelves, said first rod being rigidly secured to said carriage and extending between said storage shelves; and a second rod is rigidly secured to said carriage and extends between said storage shelves for providing increased stability.

15. The ladder system as recited in claim 13 wherein said pivot include a pair of brackets, one bracket affixed to said mounting bar and the other bracket affixed to said ladder; and a pivot bolt interposed between said brackets to permit said ladder to be swung to one side of the aisle against one of the storage shelves.

16. The ladder system as recited in claim 15 wherein spring biasing means are provided which extend around said pivot bolt and has an end abutting said mounting bar.

17. The ladder system as recited in claim 16 wherein said spring biasing means is in the form of a torsion spring.

18. A ladder system for positioning a ladder in an aisle between a pair of spaced storage shelves which are positioned on a floor, a longitudinal direction being defined as extending parallel to the spaced storage shelves and a lateral direction being defined as extending between said spaced storage shelves, the ladder system comprising:

a ladder in the aisle adapted to contact the floor;

an overhead track system adapted to be attached to said storage shelves, said ladder being mounted on said track system for selective movement in said longitudinal direction only, in said lateral direction only, and in both said longitudinal direction and said lateral direction simultaneously;

said track system including a first guide track and a second guide track, said guide tracks extending in said longitudinal direction, said track system further including a longitudinally movable roller carriage having a series of rollers on each of said guide tracks, said carriage having a first rod extending in a lateral direction between said guide tracks, said first rod being coupled to said carriage for longitudinal movement along said guide tracks;

a mounting bar for said ladder;

pairs of spaced apart rollers attached to said mounting bar and engagable with said first rod;

a pivot connecting said ladder to said mounting bar, said pivot being located at one side of said ladder;

a latch carried by said ladder for engagement with said mounting bar;

said latch being located at the other side of said ladder opposite said pivot;

said latch when in an engaged position, holding said ladder in a latched position with said mounting bar to permit the ladder to move along said first rod laterally between said storage shelves;

said latch when disengaged from said mounting bar permitting the ladder to turn about said pivot and to be moved against one of said storage shelves thereby decreasing blockage of the aisle between the storage shelves by said ladder;

a latch plate attached to said ladder;

a pivot connecting said latch to said latch plate;

spring means interposed between said latch and said latch plate for biasing said latch to a latched position on said mounting bar; and an actuating cable attached to said latch for moving it about said pivot to disengage same from said mounting bar, thereby permitting the ladder to be turned about said pivot means to one side of the aisle against one of the storage shelves.

19. The ladder system defined in claim 18 wherein said latch has a hook end and a cable end, said hook end being located on one side of said pivot for engaging said mounting bar and said cable end to which said actuating cable is attached being located on the other side of said pivot.

20. The ladder system as recited in claim 18, wherein said pairs of rollers are spaced apart a distance that is generally the diameter of said first rod, said first rod being interposed between said pairs of rollers, said rollers cooperatively gripping said first rod and guiding said ladder for lateral and pivoting movement relative to said first rod, said ladder said guide tracks being associated with said storage shelves, said first rod being rigidly secured to said carriage and extending between said storage shelves; and a second rod is rigidly secured to said carriage and extends between said storage shelves for providing increased stability.

21. The ladder system as recited in claim 20 wherein spring biasing means are provided which extend around said pivot bolt and has an end abutting said mounting bar.

22. The ladder system as recited in claim 21 wherein said spring biasing means is in the form of a torsion spring.

23. The ladder system as recited in claim 18 wherein said pivot means include a pair of brackets, one bracket affixed to said mounting bar and the other bracket affixed to said ladder; and a pivot bolt interposed between said brackets to permit said ladder to be swung to one side of the aisle against one of the storage shelves.

* * * * *

UNITED STATES PATENT AND TRADEMARK OFFICE

CERTIFICATE OF CORRECTION

PATENT NO. : 6,619,427 B1
DATED : September 16, 2003
INVENTOR(S) : Kerr

It is certified that error appears in the above-identified patent and that said Letters Patent is hereby corrected as shown below:

Column 1,
Line 55, cancel “a” after “Pivot”

Column 2,
Line 20, cancel “Which” and substitute -- which --

Column 5,
Line 20, cancel “A” before “The”
Line 23, cancel “A” before “The”
Line 41, cancel “A” before “The”

Signed and Sealed this

Fourth Day of November, 2003

JAMES E. ROGAN
*Director of the United States Patent and Trademark Office*